US008407920B2

(12) United States Patent
Draghiceanu

(10) Patent No.: US 8,407,920 B2
(45) Date of Patent: Apr. 2, 2013

(54) ROLLER IRON STEAMER ACCESSORY KIT AND SYSTEM

(76) Inventor: Amy E. Draghiceanu, Canton, GA (US)

( * ) Notice: Subject to any disclaimer, the term of this patent is extended or adjusted under 35 U.S.C. 154(b) by 918 days.

(21) Appl. No.: 12/354,750

(22) Filed: Jan. 15, 2009

(65) Prior Publication Data

US 2009/0178308 A1 Jul. 16, 2009

Related U.S. Application Data

(60) Provisional application No. 61/021,438, filed on Jan. 16, 2008.

(51) Int. Cl.
*D06F 75/10* (2006.01)
*D06F 75/08* (2006.01)

(52) U.S. Cl. ..... 38/76; 38/100

(58) Field of Classification Search ..... 38/74–77.9, 38/88, 90, 93, 94, 100, 44; 68/222; 392/395, 392/404

See application file for complete search history.

(56) References Cited

U.S. PATENT DOCUMENTS

| | | | | | |
|---|---|---|---|---|---|
| 1,453,433 | A | * | 5/1923 | Brunelli | 38/69 |
| 1,596,181 | A | * | 8/1926 | Hills | 38/100 |
| 1,690,757 | A | | 11/1928 | Steiner et al. | |
| 2,164,085 | A | | 6/1939 | Rossen | |
| 2,401,820 | A | * | 6/1946 | Fairley | 38/90 |
| 2,743,541 | A | | 5/1956 | Schultz | |
| 2,849,736 | A | | 9/1958 | Kohle | |
| 3,423,966 | A | * | 1/1969 | Mitchell | 68/222 |
| D222,502 | S | | 10/1971 | Madl et al. | |
| 3,622,246 | A | | 11/1971 | Grooms | |
| 3,646,317 | A | * | 2/1972 | Osrow | 392/337 |
| 3,703,042 | A | * | 11/1972 | Smith | 38/69 |
| 3,983,644 | A | | 10/1976 | Gowdy | |
| 4,640,028 | A | | 2/1987 | Nakada et al. | |
| 4,855,568 | A | | 8/1989 | Wilkins | |
| 4,875,301 | A | | 10/1989 | Adams | |
| D319,121 | S | | 8/1991 | Muller | |
| 5,609,047 | A | | 3/1997 | Hellman, Jr. | |
| 5,832,639 | A | | 11/1998 | Muncan | |
| 6,061,935 | A | | 5/2000 | Lee | |
| D426,924 | S | | 6/2000 | Joiner et al. | |
| 6,622,404 | B2 | | 9/2003 | Valiyambath | |
| 6,886,373 | B2 | | 5/2005 | Carrubba et al. | |
| 6,986,217 | B2 | | 1/2006 | Leung et al. | |
| 7,051,462 | B1 | | 5/2006 | Rosenzweig | |
| 2004/0144140 | A1 | | 7/2004 | Lee | |
| 2010/0058623 | A1 | * | 3/2010 | Fernandez | 38/14 |

FOREIGN PATENT DOCUMENTS

GB 002422379 A * 7/2006

* cited by examiner

*Primary Examiner* — Ismael Izaguirre
(74) *Attorney, Agent, or Firm* — George R. Reardon

(57) ABSTRACT

A roller iron steamer accessory kit is disclosed. The kit facilitates the removing of wrinkles in fabric, the loosening of wallpaper, and the cleaning and/or sanitizing of surfaces. The elements of the kit include at least one roller iron device, either configured to adapt to a portable steamer or including at least one adapter to mate the roller iron device to an element of the portable steamer that provides for the passage of steam, e.g. a wand.

9 Claims, 10 Drawing Sheets

ROLLER IRON STEAMER ACCESSORY KIT AND SYSTEM

FIELD OF THE INVENTION

The technology described herein pertains generally to kits and systems for steamers, and more particularly to devices and accessories directed to a roller iron steamer.

BACKGROUND OF THE INVENTION

Steam has been used for a variety of purposes, e.g. cleaning, disinfecting, wrinkle removal, loosening wallpaper.

Steam is traditionally used when ironing clothes and other garments including curtains and furnishing covers with a steam iron that releases steam usually under the manual control of a user. Portable steamers employing steam wands are also known to remove creases and crinkles where steam is applied typically to hanging garments and the like. In this way, curtains can be treated with steam in situ or after being hung up following cleaning or washing. Wallpaper steamers are known for moistening old wallpaper so that it can be readily removed from walls prior to redecorating. Steam may also be used to clean and/or disinfect surfaces.

Problems exist with current steaming devices and methods.

Handheld steam irons are cumbersome and time consuming to use.

The large machinery used by laundry professionals to press items are generally too costly and inconvenient for the average consumer.

Household portable steamers work well to reduce superficial wrinkles in fabrics, but stubborn wrinkles are difficult to remove quickly with steam alone. It is also difficult to produce a crisp surface and make crisp creases in fabrics when using a household portable steamer alone.

Wallpaper removal steamers are generally pointed at, or held directly on, wallpaper to be removed in order to loosen the wallpaper so it may then be pealed pack or scraped off. However, this method, to be effective, only works on a small area at a time.

Additionally, there are numerous methods for cleaning and disinfecting flat surfaces such as walls and floors. One of these methods includes forced steam to remove surface impurities. This is effective for not only cleaning purposes but also for sanitizing and killing bacteria, viruses, mold and dust mites. However, one problem with this method is that, although steamers are effective in loosening dirt and debris, an additional method or step is required in order to remove the dirt and residue left behind.

Related art that is directed to steamer devices includes the following patents and published patent applications.

U.S. Pat. No. 1,690,757, issued to Steiner et al. on Nov. 6, 1928, discloses a device for steaming and brushing clothes in one operation, where the flow of steam may be readily controlled from the handle of the device.

U.S. Pat. No. 2,164,085, issued to Rossen on Jun. 27, 1939, discloses a self-propelled electric iron.

U.S. Pat. No. 2,743,541, issued to Schultz on May 1, 1956, discloses an attachment for a garment steaming and pressing machine.

U.S. Pat. No. 2,849,736, issued to Kohle on Sep. 2, 1958, discloses a fabric steaming and brushing device.

U.S. Pat. No. D222,502, issued to Madl, et al. on Oct. 26, 1971, illustrates a steam generating appliance for removing wrinkles from cloth articles.

U.S. Pat. No. 3,622,246, issued to Grooms on Nov. 23, 1971, discloses a painting device comprising a functionally shaped reservoir provided with an aperture therein, a paint dispensing roller operably mounted on said reservoir and disposed near and within said aperture, wiper blades operably mounted on said reservoir and disposed near the peripheral surface of said roller, and handle means.

U.S. Pat. No. 3,983,644, issued to Gowdy on Oct. 5, 1976, discloses a combination flash/flood boiler steam iron with a water tank having a fill opening and a liquid fill valve means to close the tank to ambient and having a steam generating soleplate with ports and boiler therein and a water valve to start and stop a metered flow of water to the boiler for generating flash steam. In this combination the improvement is added for selectively operating the iron with a flooded boiler comprising a separate flood valve means operable to partially empty the tank and fill the boiler to a flooded condition to generate saturated steam. A tubular means connects the boiler and water tank to balance both pressure within the iron and water level during flooded operation and to conduct all the generated steam to the tank interior. A steam passage distributing means connects to the soleplate ports and the distributing means is separated from the boiler generating means. Pressure control conduit means connects the tank interior and the distributing means whereby the iron operates dry with the valves closed to prevent steam generation; it operates with flash steam with the water valve open; and it operates flooded with saturated steam with the flood valve open; thus providing flexibility in several modes of operation. Additionally, a removable spout may be attached to the fill opening forming a steam nozzle so the iron may be used as a fabric steamer on vertically hanging garments.

U.S. Pat. No. 4,640,028, issued to Nakada et al. on Feb. 3, 1987, discloses a portable travel electric steam iron which also functions as a steamer having an aperture provided in a rear portion of the bottom of a water tank which supplies water into steam generating chambers from the water tank. Water dripping through the aperture is received by a water receiving surface provided on the center or on the front side of the center of a base. A handle which includes two straight positions separated by a bend is securable to an iron main body both in the operative position and storage position. An actuator for opening and closing an aperture is disposed in a space above the water tank, in the vicinity of a fixing portion at which the handle is fixed to the iron main body, thus providing a compact construction which is easy to handle.

U.S. Pat. No. 4,855,568, issued to Wilkins on Aug. 8, 1989, discloses a hand-held wallpaper steamer for use in wallpaper stripping having a housing of two-part clam shell construction, a base portion with a floor and a peripheral wall to form a chamber open at one face. The clam shells are contoured to receive the base portion at the open end of the housing to close that end. The clam shells are shaped to form a handle spaced from the base portion and extending in a direction generally parallel to the base portion. The clam shells are also shaped to accommodate a removable water tank.

U.S. Pat. No. 4,875,301, issued to Adams on Oct. 24, 1989, discloses a method and apparatus for removing wrinkles from a table skirt includes a cylinder capable of holding the table skirt and having a porous portion. The apparatus further includes devices for rotating the cylinder and for delivering steam from an outside source through the cylinder so that the steam passes through the porous portion and removes the wrinkles.

U.S. Pat. No. D319,121, issued to Muller on Aug. 13, 1991, illustrates a garment steamer.

U.S. Pat. No. 5,609,047, issued to Hellman, Jr. et al. on Mar. 11, 1997, discloses a portable garment steaming device for use in the home which emits steam through a retractable nozzle plate of a safety nozzle assembly which when retracted prevents against accidental touching of the hot nozzle plate. The garment steaming device also includes a clothes hanger assembly for hanging the article of clothing to be steamed. A water bottle compartment for supplying water to be generated as steam for the safety nozzle assembly is further provided which is detachably mounted for refilling.

U.S. Pat. No. 5,832,639, issued to Muncan on Nov. 10, 1998, discloses a portable garment finishing apparatus of the technology disclosed herein comprises a water reservoir, a water conversion device, and a conventional steam heated iron. The present apparatus is designed to operate from a single 115 v power source, such as an ordinary wall outlet. Using a water-level probe in connection with a circuit board having a relay switch, a pump is regulated in its supply of water from the reservoir to the steam chamber in the conversion device. Water continuously is converted to steam and constantly released to the iron where it maintains the iron temperature and may be released onto a garment for finishing. The steam returns to the conversion device where it condenses in a steam trap valve for subsequent return to the reservoir, where it may be recycled.

U.S. Pat. No. 6,061,935, issued to Lee on May 16, 2000, discloses a dual appliance for steam treating garments having a central reservoir and an electrical water pump to supply water to a steamer or a steam iron. Separate braided flexible cables supply water and power to the steamer and to the steam iron, to which the respective cables are respectively permanently connected. Plugs are provided at the ends of the cables for connection to a socket.

U.S. Pat. No. D426,924, issued to Joiner et al. on Jun. 20, 2000, illustrates a steamer head.

U.S. Pat. No. 6,622,404, issued to Valiyambath on Sep. 23, 2003, discloses a steamer arrangement comprising a cordless steaming device and a stand for holding the steaming device, the steaming device having a water tank, the stand having an electrically heated boiler, the steaming device and the stand being provided with mechanical coupling means, including valves for coupling the water tank of the steaming device to the boiler of the stand for obtaining a fluid communication between the boiler and the water tank when the steaming device is attached to the stand. When the steaming device is attached to the stand, steam flows from the boiler to the water tank, resulting in high-pressure/temperature steam in the water tank. Detached from the stand the cordless steaming device can be used directly for steaming. The cordless steaming device may be a cordless iron with the soleplate heated electrically, while simultaneously steam is charged when the iron is placed on the stand.

U.S. Patent Publication No. 2004/0144140, inventor Lee, published on Jul. 29, 2004, discloses a steamer attachment which allows a user to selectively dispense steam from a steamer. The attachment broadly comprises a body, a first and second steam distributor located in a head of the body, and a valve located in a handle of the body. The first distributor preferably comprises a nozzle to concentrate the steam and a brush. The second distributor preferably comprises a plurality of holes to disperse the steam. The second distributor may also include a detachable diffuser to further disperse the steam. The valve preferably opens a first path toward the first distributor before closing a second path toward the second distributor. Thus, the steam always has at least one available path, in order to prevent pressure buildup within the steamer.

U.S. Pat. No. 6,886,373, issued to Carrubba et al. on May 3, 2005, discloses a garment steamer for domestic use that cooperates with a variety of different attachments to provide a variety of different steam or vapor emitting effects. The garment steamer also has an ionic and/or ozone generating/emitting feature to facilitate neutralizing odor and removing undesirable particulate from a garment. The garment steamer may also have a hanger and rod assembly in which a collapsible hanger selectively cooperates with a telescopic rod, which is connected to a base, such that the hanger can be selectively positioned at any location along the height of the rod and/or disengaged from the rod. The garment steamer also includes a fluid heating assembly enclosed in the base, a separable fluid container in separable fluid communication with the fluid heating assembly, and a separable hose in separable fluid communication with the fluid heating assembly, as well as with the variety of different attachments.

U.S. Pat. No. 6,986,217, issued to Leung et al. on Jan. 17, 2006, discloses a hand held appliance for use in applying steam to a garment or other item made of fabric includes a pump, a boiler and a switch. Power is applied through the switch to the pump. The pump pumps water from the water tank to the boiler. The water is converted to steam in the boiler and is expelled from the appliance through a set of nozzles. The appliance may include optional attachments for performing other operations on garments or fabric, for example, applying pressure, brushing, scrubbing, or lint removal.

U.S. Pat. No. 7,051,462, issued to Rosenzweig on May 30, 2006, discloses a combination steam cleaner and steam iron includes a steam generator, a steam cleaner and a steam iron. The steam generator includes a voltage control device serially connected to a boiler element for boiling water to produce steam. The steam cleaner is attachable to the steam generator, a nozzle that dispenses the steam, and a circuit designed to supply power to the boiler element when the steam cleaner is attached to the steam generator. The steam iron is attachable to the steam generator, includes an iron heating element for heating the iron, and includes a circuit designed to supply power to the iron heating element in addition to supplying power to the boiler element, when the steam iron is attached to the steam generator. The steam generator also includes a steam release valve that supplies the steam and which is controlled by respective switches within the steam cleaner and iron.

Generally available portable steaming appliances include those provided by TOBI®, CONAIR®, JIFFY®, ROWENTA®, ACE HI®, EURO-PRO®, STEAM FAST®, SAMSONITE®, HOMEDICS®, SUNBEAM®, RELIABLE®, SHARPER IMAGE®, SHARK®, SCUNCI®, and others.

While these patents, published patent applications, other previous methods and devices have attempted to solve the problems that they addressed, none have utilized or disclosed a roller iron steamer accessory kit and system capable of loosening wall paper, cleaning, sanitizing and pressing, as does embodiments of the technology disclosed herein.

It is therefore an aspect of the technology described herein to provide a new and improved roller iron steamer accessory kit and system which has all the advantages of the prior art steaming devices and none of the disadvantages.

Therefore, a need exists for a roller iron steamer accessory kit and system with these attributes and functionalities. The roller iron steamer accessory kit and system according to embodiments of the technology disclosed herein substantially departs from the conventional concepts and designs of the prior art. It can be appreciated that there exists a continuing need for a new and improved roller iron steamer accessory kit and system which can be used commercially. In this regard, the technology disclosed herein substantially fulfills these objectives.

BRIEF SUMMARY OF THE INVENTION

In general, the technology described herein features a roller iron steamer accessory kit and system directed to the removing of wrinkles in fabric, the loosening of wallpaper, the cleaning and/or sanitizing of substantially flat surfaces. In a typical embodiment, the elements of the kit include at least one roller iron device, either configured to adapt to a portable steamer or including at least one adapter to mate the roller iron device to an element of the portable steamer that provides for the passage of steam, e.g. a wand.

The general purpose of the technology disclosed herein, which will be described subsequently in greater detail, is to provide a handheld method for ironing or pressing fabric, cleaning, sanitizing, and as an aid in the removal of wallpaper, using a roller type device.

In one embodiment of the technology disclosed herein, the roller device pertains to a steamer-specific attachment to an already existing steamer, where the roller device is formed on one end to attach directly to a corresponding end to an element of a specific model of a steamer, such as a steamer wand.

In another embodiment of the technology disclosed herein, the roller device pertains to a generic roller device plus an adapter for a specific steamer model where the adapter connects one end of the generic roller device to a corresponding element of the specific steamer model, such as a steamer wand.

In yet another embodiment of the technology disclosed herein, the roller device is in itself an iron/steamer assembly with its own source of power, water reservoir, steam generation and steam control.

In an exemplary embodiment, the technology disclosed herein is comprised of a roller assembly having at least one roller element, a roller housing element, and a connection element so the roller assembly may be attached to a portable steamer.

Additional element or features include the following:

- the roller element may be configured to be removed from the housing element
- the roller assembly may include a sleeve element
- the roller element may include a roller cover element, which may be placed over the roller for cleaning purposes
- the roller assembly may include an extension element, e.g. a handle or pole, which can be fastened to, or screwed into, the connection element to allow a user to roll over large areas, or to reach hard-to-get-to places
- the roller iron steamer accessory kit may include a storage tray element
- the roller iron steamer accessory kit may include a protective cover element
- the roller iron steamer accessory kit may include a squeegee/scraper element that may be placed along one or more edges of the housing element
- the adapter may have a handle disposed thereon
- the roller iron steamer accessory kit may include connective tubing
- a roller cover may be utilized for pressing delicate fabrics One way the technology disclosed herein can be used is as follows:

- While the steamer is unplugged, attach the roller attachment to the steamer by utilizing tubing, adaptors, or by screwing or snapping into place.
- Fill the water chamber and set the temperature settings of the unit using specific manufactures instructions.
- Once the unit has sufficiently heated up, press, iron, or steam material by rolling the roller attachment over the desired area.

Another way the technology disclosed herein can be used is as follows:

- While the steamer is unplugged, attach the roller attachment to the steamer by utilizing tubing, adaptors, or by screwing or snapping into place.
- Fill the water chamber and set the temperature settings of the unit using specific manufactures instructions.
- Once the unit has sufficiently heated up, roll the attachment over area to be cleaned.
- The squeegee/scraper and the roller covers may also be used for the purpose of cleaning and removing debris.

Yet another way the technology disclosed herein can be used is as follows:

- While the steamer is unplugged, attach the roller attachment to the steamer by utilizing tubing, adaptors, or by screwing or snapping into place.
- Fill the water chamber and set the temperature settings of the unit using specific manufactures instructions.
- Once the unit has sufficiently heated up, roll the attachment over area of wallpaper to be removed.
- The squeegee/scraper may also be used for the purpose of removing wallpaper.

The technology disclosed herein has the following advantages:

- easy to use
- adapted to connect to various types of steamers
- convenient
- portable
- able to be used on large areas easily
- configured for attaching an extension to the unit for use while working on large, high, or hard to reach area
- provides a cost saving alternative to professional ironing
- may be easily and efficiently manufactured and marketed
- is of durable and reliable construction
- has multiple uses and applications Another embodiment of the technology disclosed herein is comprised of a cylindrical rotary iron with at least one arm. There is a heating element or elements surrounded by at least one heat conducting, ridged, cylindrical roller. There is at least one handle and a cord with a plug. This embodiment may also be configured to have a temperature control element, an on-and-off element, a self-contained water chamber, an external water storage element, a sleeve or roller cover can be used over the roller for the purpose of cleaning, an extension element, a squeegee/scraper element.

This embodiment may be used as follows:

- Plug the device into the wall socket and turn the unit on.
- Set the unit to the desired temperature setting.
- Allow the device to heat up and grasping the handle of the device.
- Place the roller portion on the fabric to be ironed.
- Roll the iron over the area to be ironed until the wrinkles ore gone.
- The roller cover may also be utilized for pressing delicate fabrics.

Another way to use this embodiment is as follows:

- Fill the water chamber with water.
- Plug the device into a wall socket and turn the unit on.
- Set the unit to the desired temperature setting.
- Allow the device to heat up.
- Holding the handle of the device, steam or spray the fabric while ironing.
- The roller cover may also be utilized for pressing delicate fabrics.

Yet another way to use this embodiment is as follows:

Fill the water chamber with water and place a roller cover over the rotary portion of the device.

Plug the device into the wall socket and turn the unit on.

Allow the unit to heat up to the desired temperature.

Holding the handle of the device, steam and roll over surface for the purpose of cleaning, disinfecting or in order to kill dust mites.

The squeegee/scraper and the roller covers may also be used for the purpose of cleaning and removing debris.

Still another way to use this embodiment is as follows:

Fill the water chamber with water.

Attach an extension element, e.g., a pole

Plug the device into a wall socket and turn on the device.

Set to the appropriate temperature setting.

Allow the unit to heat up.

Holding the handle of the device, steam and roll over surface for the purpose of loosening wallpaper.

The squeegee/scraper may also be used for the purpose of removing wallpaper.

There has thus been outlined, rather broadly, the more important features of the technology disclosed herein in order that the detailed description thereof that follows may be better understood, and in order that the present contribution to the art may be better appreciated. There are, of course, additional features of the technology disclosed herein that will be described hereinafter and which will form the subject matter of the claims appended hereto.

In this respect, before explaining at least one embodiment of the technology disclosed herein in detail, it is to be understood that the technology disclosed herein is not limited in its application to the details of construction and to the arrangements of the components set forth in the following description or illustrated in the drawings. The technology disclosed herein is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the technology disclosed herein. It is important, therefore, that the claims be regarded as including such equivalent constructions insofar as they do not depart from the spirit and scope of the technology disclosed herein.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

The foregoing patent and other information reflect the state of the art of which the inventor is aware and are tendered with a view toward discharging the inventor's acknowledged duty of candor in disclosing information that may be pertinent to the patentability of the technology disclosed herein. It is respectfully stipulated, however, that the foregoing patent and other information do not teach or render obvious, singly or when considered in combination, the inventor's claimed invention.

These aspects and advantages, together with other objects of the technology disclosed herein, along with the various features of novelty which characterize the technology disclosed herein, are pointed out with particularity in the claims annexed to and forming a part of this disclosure. For a better understanding of the technology disclosed herein, its operating advantages and the specific objects attained by its uses, reference should be had to the accompanying drawings and descriptive matter in which there are illustrated preferred embodiments of the technology disclosed herein.

BRIEF DESCRIPTION OF THE SEVERAL VIEWS OF THE DRAWINGS

The technology described herein, together with further advantages thereof, may best be understood by reference to the following description of the simplest form of the technology described herein, taken in conjunction with the accompanying drawings in which.

DETAILED DESCRIPTION OF THE INVENTION

The technology disclosed herein will now be described in detail with reference to at least one preferred embodiment thereof as illustrated in the accompanying drawings. In the following description, numerous specific details are set forth in order to provide a thorough understanding of the technology disclosed herein. It will be apparent, however, to one skilled in the art, that the technology disclosed herein may be practiced without some or all of these specific details. In other instances, well known operations have not been described in detail so not to unnecessarily obscure the technology disclosed herein.

Figure 1:
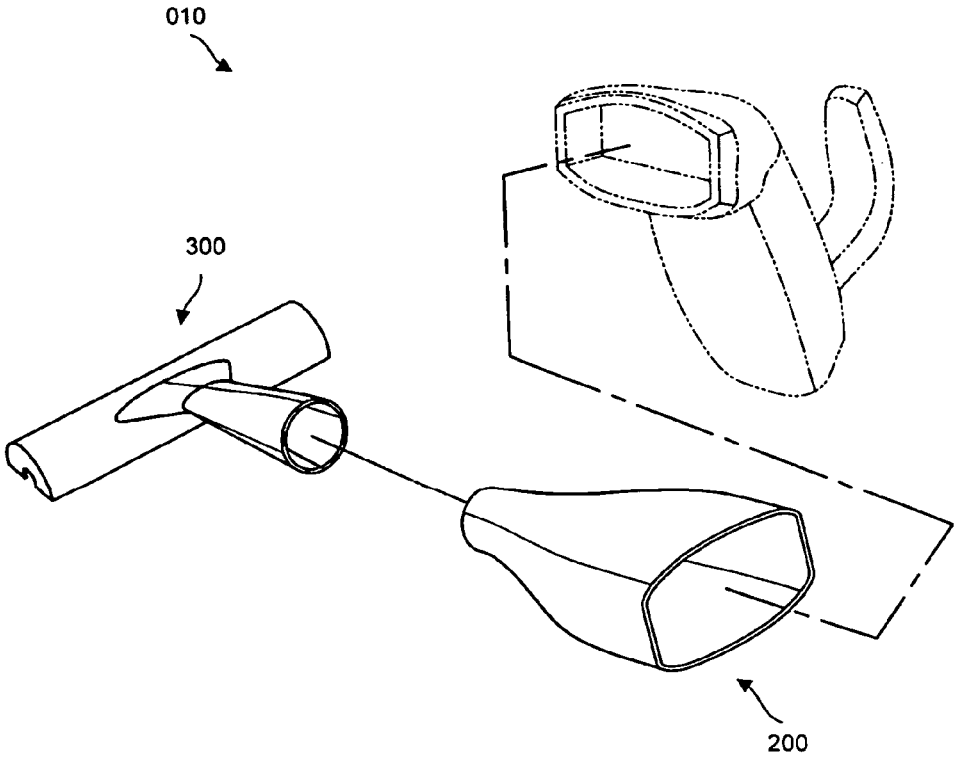
FIG. 1 illustrates a perspective view of a roller iron steamer assembly with a portable steamer specific adapter, according to an embodiment of the technology disclosed herein.
Figure 2:
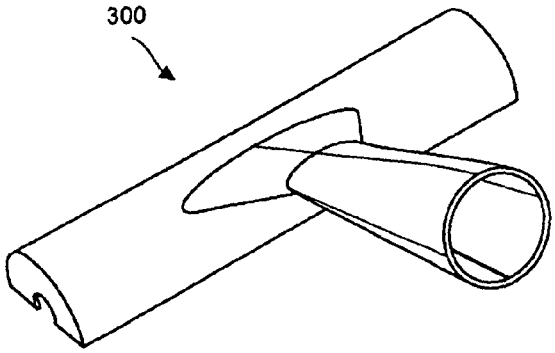
FIG. 2 illustrates a perspective view of a roller iron steamer assembly, according to an embodiment of the technology disclosed herein.
Figure 3:
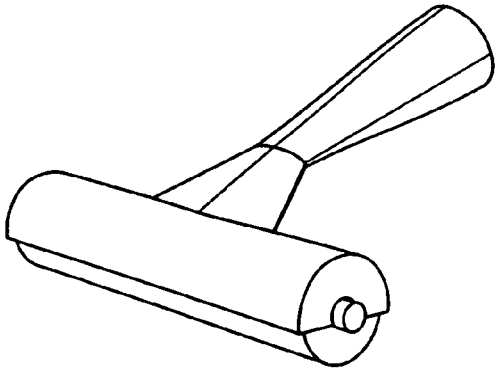
FIG. 3 illustrates a perspective view of a roller iron steamer assembly, according to an embodiment of the technology disclosed herein.
Figure 4:
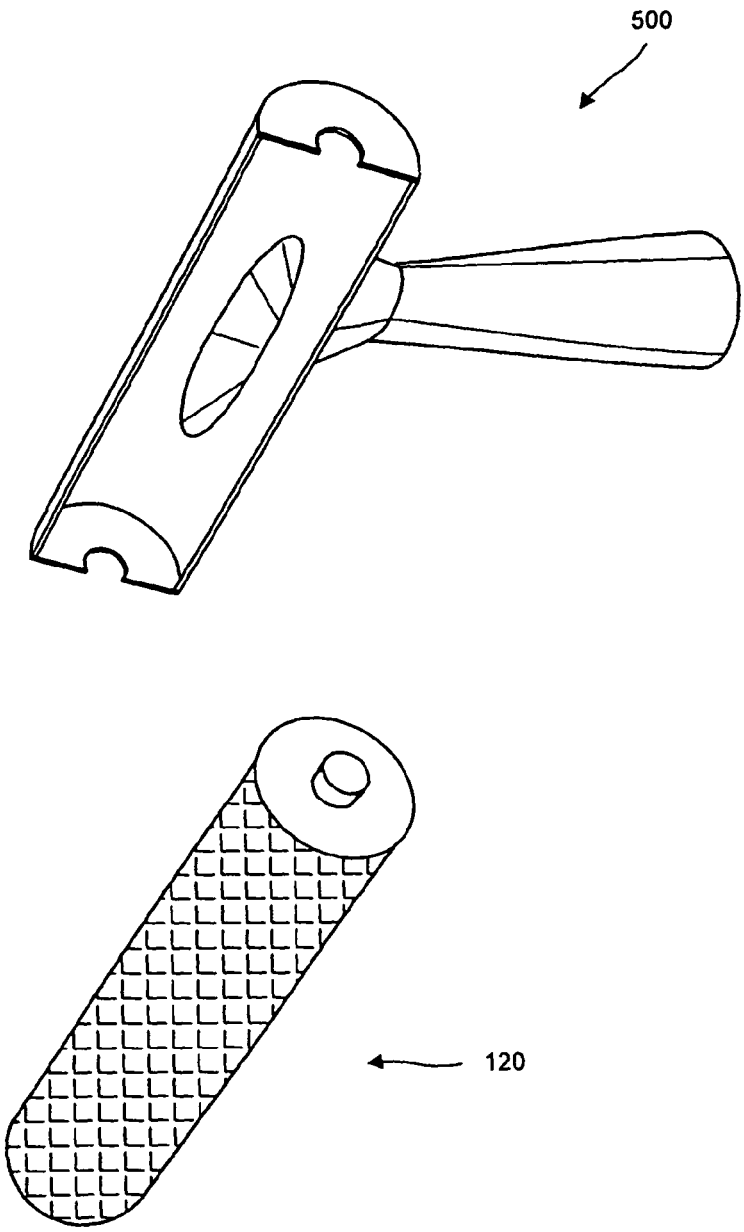
FIG. 4 illustrates a perspective view of a roller iron steamer assembly showing a releasable roller, according to an embodiment of the technology disclosed herein.
Figure 5:
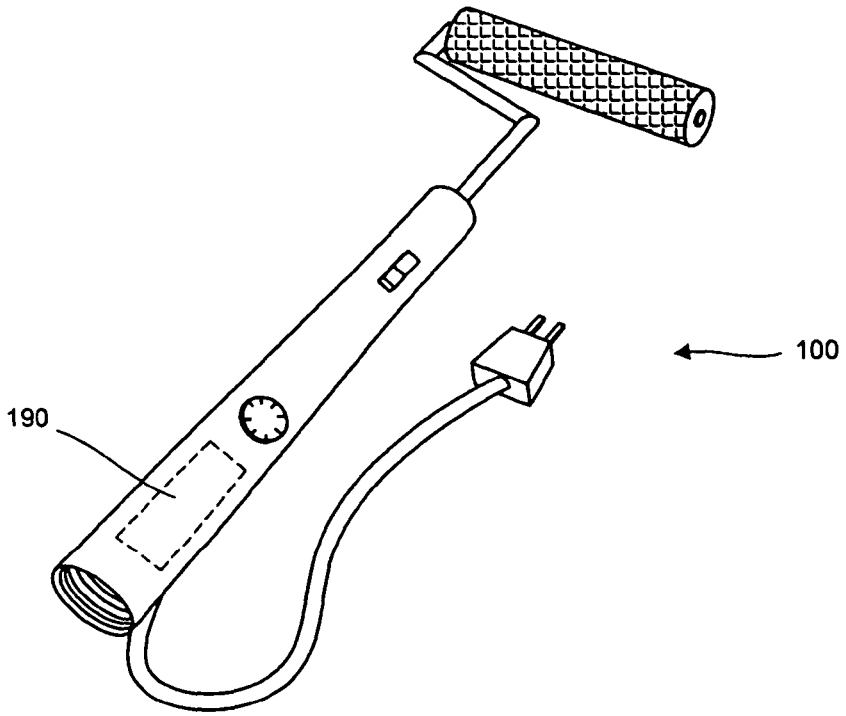
FIG. 5 illustrates a perspective view of a roller iron steamer device having elements for power, steam control and water reservoir (not shown), according to an embodiment of the technology disclosed herein.
Figure 6:
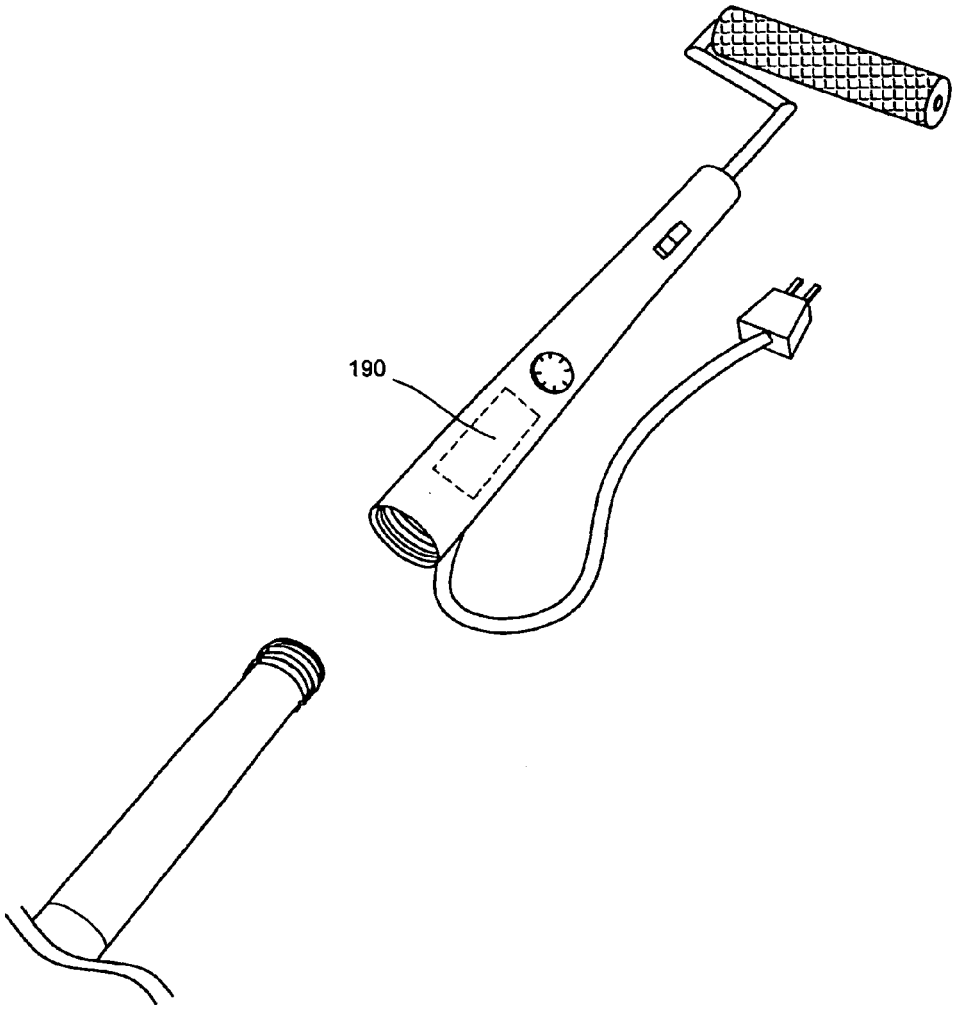
FIG. 6 illustrates a perspective view of a roller iron steamer device having elements for power, steam control and water reservoir (not shown) plus extension tubing and extension pole, according to an embodiment of the technology disclosed herein.
Figure 7:
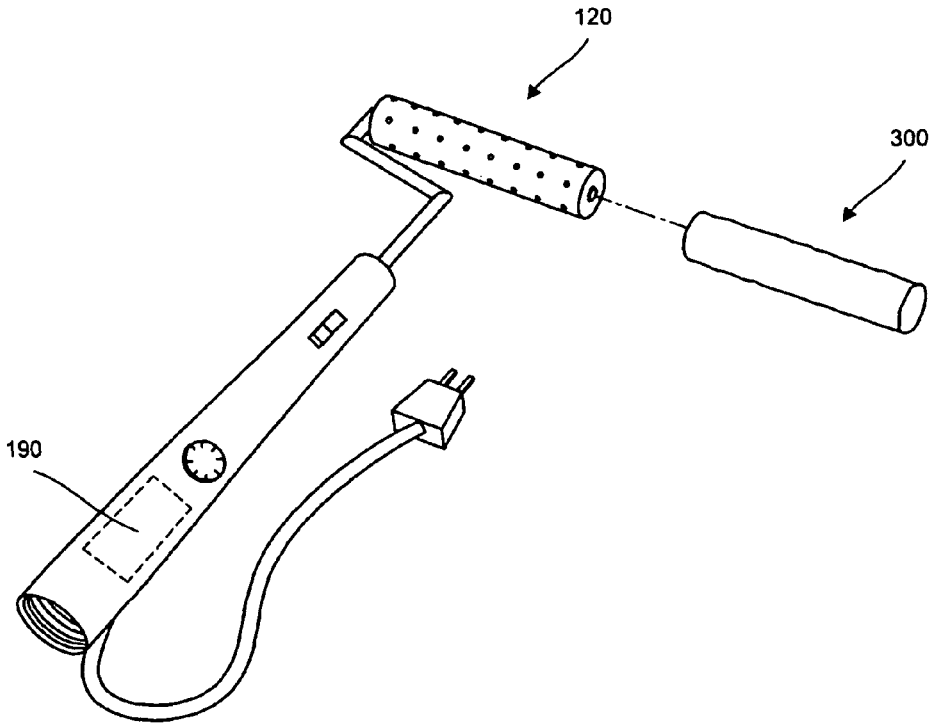
FIG. 7 illustrates a perspective view of a roller iron steamer device having elements for power, steam control and water reservoir, showing a releasable cover for the roller, according to an embodiment of the technology disclosed herein.
Figure 8:
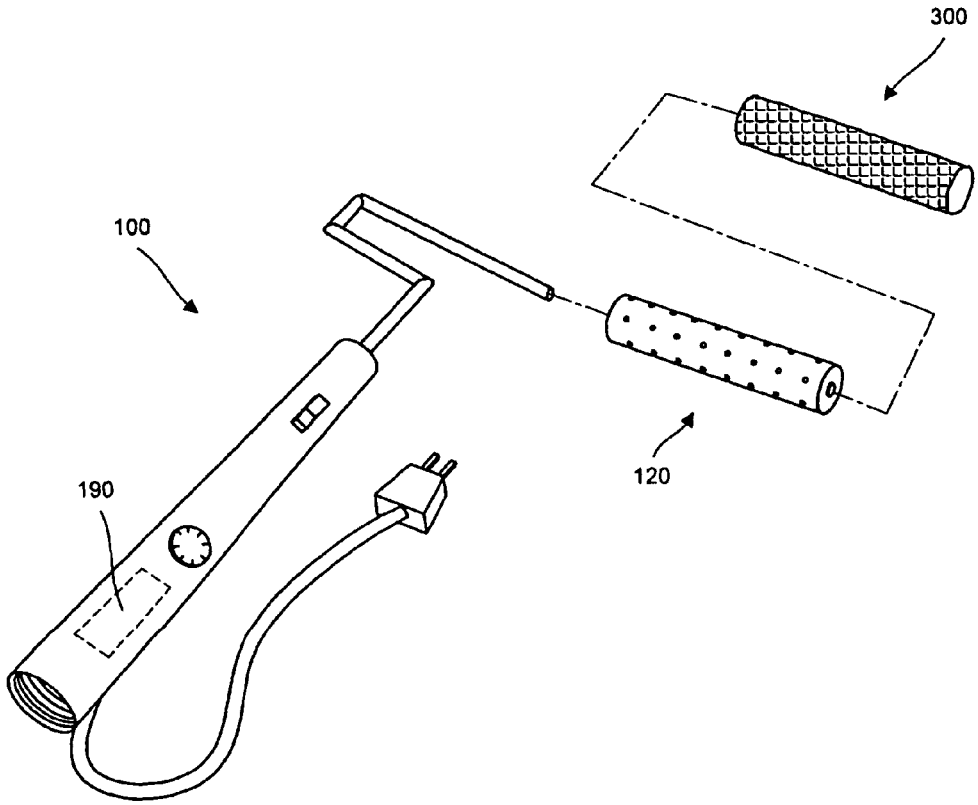
FIG. 8 illustrates a perspective view of a roller iron steamer device having elements for power, steam control and water reservoir, showing a releasable cover for the roller, according to an embodiment of the technology disclosed herein.
Figure 9:
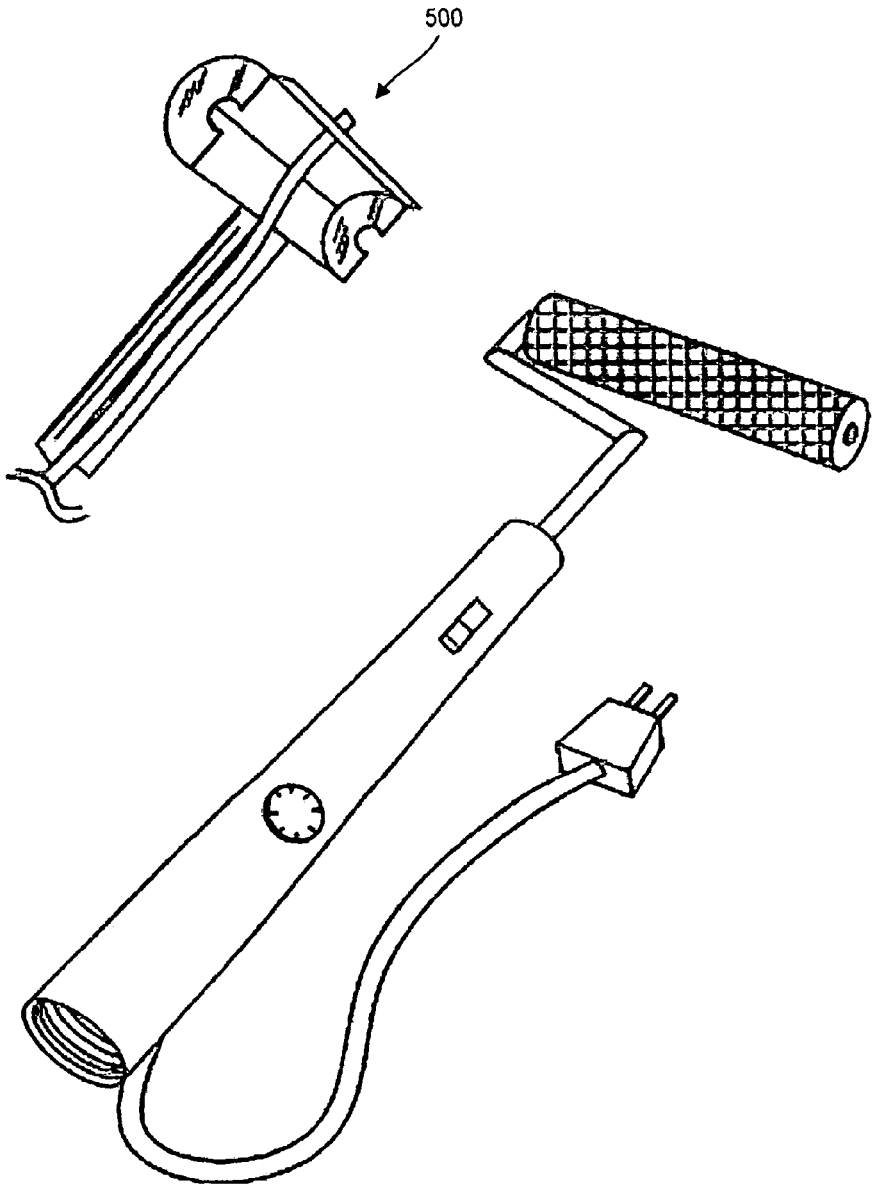
FIG. 9 illustrates a perspective view of a roller iron steamer device having a squeegee and sprayer elements.
Figure 10:
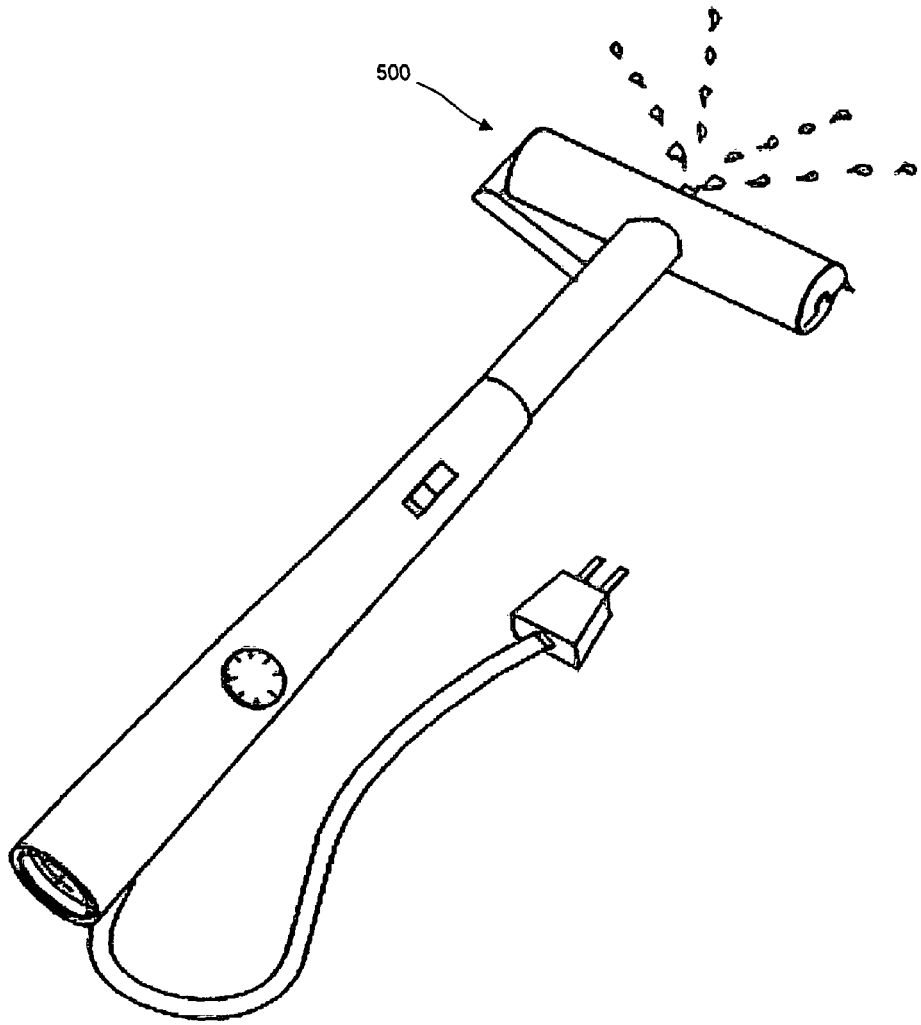
FIG. 10 illustrates a perspective view of a roller iron steamer device with the sprayer element activated.

Referring to the drawings, FIGS. 1-8, wherein like reference numerals designate corresponding parts throughout the several figures, in an exemplary embodiment a roller iron steamer accessory kit is comprised of roller iron assembly 100, a roller iron assembly adapter 200; a roller iron sleeve 300; a storage tray 400 (not shown), a squeegee/scraper assembly 500; and a container 600 (not shown), where the roller iron assembly 100 includes a first housing having a first housing distal end and a first housing proximal end, and where the roller iron assembly adapter 200 includes a second housing having a second housing distal end and a second housing proximal end, where the first housing proximal end is configured to releaseably connect with the second housing distal end, and where the second housing proximal end is configured to releasably connect with a wand of a conventional portable steamer, where the first housing distal end is configured to rotatably hold a roller having an array of steam escape holes disposed thereon, and where the first housing distal end is configured to releasably hold the roller 120, and where the roller iron sleeve 300 is steam permeable and releaseably covers the roller 120, and where the squeegee/scraper assembly 500 is configured for attaching laterally to the first housing.

In another embodiment a roller iron steamer kit 010 comprises a roller iron assembly 100; and a plurality of a roller iron assembly adapter 200; where each roller iron assembly adapter 200 releasably connects the roller iron assembly 100 to a different model of a portable steamer. These portable steamers include, but are not limited to TOBI®, CONAIR®, JIFFY®, ROWENTA®, ACE HI®, EURO-PRO®, STEAM FAST®, SAMSONITE®, HOMEDICS®, SUNBEAM®, RELIABLE®, SHARPER IMAGE®, SHARK®, or SCUNCI® portable steamers. The roller iron steamer kit 010 may be further comprised of a roller iron sleeve 300, a storage tray 400 (not shown), a squeegee/scraper assembly 500 and/or a container 600 (not shown) for holding the contents of the roller iron steamer kit 010 elements.

In another embodiment of the technology disclosed herein a roller iron steamer kit 010 comprises a roller iron steamer attachment 100 operable to join with a wand of a portable steamer to dispense steam from the portable steamer, the roller iron assembly comprising a body having a handle and a head, wherein the head includes a laterally rotating cylinder and an opening permitting the rotating cylinder to contact a surface. The roller iron steamer kit 010 may be further comprised of a roller iron sleeve 300, a storage tray 400 (not shown), a squeegee/scraper assembly 500, and/or a container 600 (not shown) for holding the contents of the roller iron steamer kit 010. The container may be, but is not limited to, a bag or a case.

In some embodiments the roller iron steamer attachment may have a water reservoir 190 for steam generation. In other embodiments the roller iron steamer attachment channels steam from a steamer.

With respect to the above description, it is to be realized that the optimum dimensional relationships for the parts of the technology disclosed herein, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the technology disclosed herein.

Therefore, the foregoing is considered as illustrative only of the principles of the technology disclosed herein. Further, since numerous modification and changes will readily occur to those skilled in the art, it is not desired to limit the technology disclosed herein to the exact construction and operation shown and described, and accordingly, all suitable modification and equivalents may be resorted to, falling within the scope of the technology disclosed herein.

The foregoing description and drawings comprise illustrative embodiments of the technology disclosed herein. Having thus described exemplary embodiments of the technology disclosed herein, it should be noted by those skilled in the art that the within disclosures are exemplary only, and that various other alternatives, adaptations and modifications may be made within the scope of the technology disclosed herein. Merely listing or numbering the steps of a method in a certain order does not constitute any limitation on the order of the steps of that method. Many modifications and other embodiments of the technology described herein will come to mind to one skilled in the art to which this technology disclosed herein pertains having the benefit of the teachings presented in the foregoing description and the associated drawings. Although specific terms may be employed herein, they are used in a generic and descriptive sense only and not for purposes of limitation. Accordingly, the technology disclosed herein is not limited to the specific embodiments illustrated herein, but is limited only by the following claims.

What is claimed is:

1. A roller iron steamer kit comprising:
a roller iron assembly;
a roller iron assembly adapter;
a roller iron sleeve;
a storage tray;
a squeegee assembly; and
a container,
wherein the roller iron assembly includes a first housing having a first housing distal end and a first housing proximal end,
wherein the roller iron assembly adapter includes a second housing having a second housing distal end and a second housing proximal end,
wherein the first housing proximal end is configured to releaseably connect with the second housing distal end,
wherein the second housing proximal end is configured to releasably connect with a wand of a conventional portable steamer,
wherein the first housing distal end is configured to rotatably hold a roller having an array of steam escape holes disposed thereon,
wherein the first housing distal end is configured to releasably hold the roller,
wherein the roller iron sleeve is steam permeable and releaseably covers the roller,
wherein the squeegee assembly is configured for attaching laterally to the first housing.

2. A roller iron steamer kit comprising:
a roller iron assembly;
a plurality of a roller iron assembly adapter;
wherein each roller iron assembly adapter releasably connects the roller iron assembly to a different model of a portable steamer;
a roller iron sleeve;
a storage tray; and
a squeegee assembly.

3. A roller iron steamer kit comprising:
a roller iron assembly;
a plurality of a roller iron assembly adapter;
wherein each roller iron assembly adapter releasable connects the roller iron assembly to a different model of a portable steamer;
a roller iron sleeve;

a storage tray; and a squeegee assembly.

4. A roller iron steamer kit comprising:

a roller iron assembly;

a plurality of a roller iron assembly adapter;

wherein each roller iron assembly adapter releasably connects the roller iron assembly to a different model of a portable steamer; and a container for holding the roller iron assembly, the plurality of a roller iron assembly adapter, a roller iron sleeve, a storage tray, and a squeegee assembly.

5. A roller iron steamer kit comprising:

a roller iron steamer attachment operable to join with a wand of a portable steamer to dispense steam from the portable steamer, the roller iron assembly comprising a body having a handle and a head, wherein the head includes a laterally rotating cylinder and an opening permitting the rotating cylinder to contact a surface; and a squeegee assembly.

6. A roller iron steamer kit comprising:

a roller iron steamer attachment operable to join with a wand of a portable steamer to dispense steam from the portable steamer, the roller iron assembly comprising a body having a handle and a head, wherein the head includes a laterally rotating cylinder and an opening permitting the rotating cylinder to contact a surface;

a roller iron sleeve;

a storage tray;

and a squeegee assembly.

7. A roller iron steamer kit comprising:

a roller iron steamer attachment operable to join with a wand of a portable steamer to dispense steam from the portable steamer, the roller iron assembly comprising a body having a handle and a head, wherein the head includes a laterally rotating cylinder and an opening permitting the rotating cylinder to contact a surface; and a container for holding the roller iron steamer attachment, a roller iron sleeve, a storage tray, and a squeegee assembly.

8. The roller iron steamer kit of claim 7, wherein the container is a bag.

9. The roller iron steamer kit of claim 7, wherein the container is a case.

* * * * *